United States Patent [19]

Blatt

[11] 4,401,217

[45] Aug. 30, 1983

[54] ROLL RETAINER

[75] Inventor: David H. Blatt, Elkins Park, Pa.

[73] Assignee: Franklin Container Corporation, Philadelphia, Pa.

[21] Appl. No.: 240,318

[22] Filed: Mar. 4, 1981

[51] Int. Cl.[3] ..... B65D 85/66

[52] U.S. Cl. ..... 206/408; 206/386

[58] Field of Search ..... 206/408, 413–416, 206/386, 600; 217/43 A, 43 R; 108/55.1, 55.3, 55.5; 229/DIG. 8

[56] References Cited

U.S. PATENT DOCUMENTS

| | | | |
|---|---|---|---|
| 2,607,476 | 8/1952 | Rockefeller | 206/408 |
| 2,743,009 | 4/1956 | Williamson et al. | 206/408 |
| 2,774,474 | 12/1956 | Phillips | 206/386 |
| 2,803,339 | 8/1957 | Kuchenbecker | 206/408 |
| 3,315,800 | 4/1967 | Wagner | 217/43 A |
| 3,472,363 | 10/1969 | Rustin, Jr. et al. | 108/55.1 |
| 4.027,794 | 6/1977 | Olson | 206/446 |

FOREIGN PATENT DOCUMENTS

| | | | |
|---|---|---|---|
| 7426269 | 2/1976 | France | 206/386 |
| 12606 | of 1913 | United Kingdom | 206/408 |

*Primary Examiner*—George E. Lowrance
*Assistant Examiner*—Jimmy G. Foster
*Attorney, Agent, or Firm*—Walter B. Udell

[57] ABSTRACT

A container for shipping and storing large hollow cylindrical rolls of either solid material or wound sheet material. A skid or pallet is combined with a pair of special corrugated paperboard end pads, one for each end of the roll, a pair of spaced apart anti-roll retainers extending longitudinally of and secured to the top of the pallet and between which the roll is placed, a pair of top braces extending between and interfitted with the end pads, a pair of banding straps which transversely encircle and secure together the retained roll and the anti-roll retainers, and a pair of banding straps which longitudinally encircle and secure together the pallet and end pads and top braces. The end pads and anti-roll retainers secure the retained roll from endwise shifting and sidewise rolling motion, and are constructed so that a standard sized end section is utilizable with rolls of widely varying diameters.

1 Claim, 6 Drawing Figures

FIG. 1
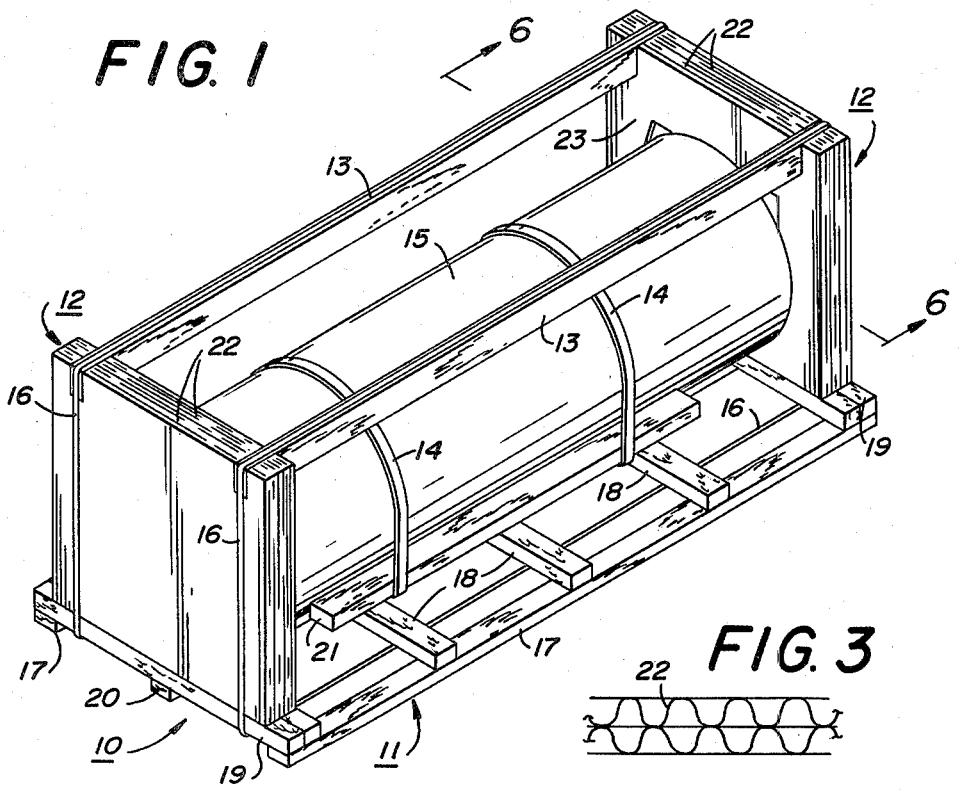
FIG. 3
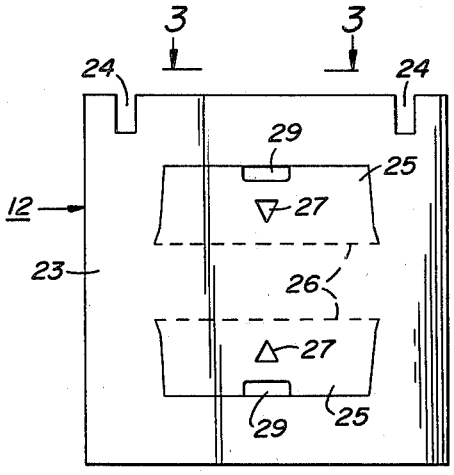
FIG. 2
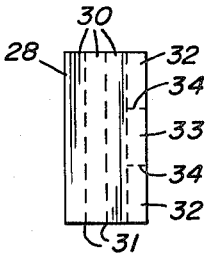
FIG. 4

ROLL RETAINER

This invention relates to roll retainers, and more particularly relates to containers for shipping and storing large hollow cylindrical rolls of either solid material or wound sheet material. Such rolls may be six to ten feet in length and up to several feet in diameter, and consequently are of substantial size and weight.

In the past, it has been necessary to construct individual specialized shipping containers for rolls of this type, entailing substantial material and labor costs, in order to prevent destructive movement of the rolls within the containers. Each different sized roll required a different sized container, and consequently the containers were essentially custom constructed. The present invention provides a simple structure which is relatively inexpensive to fabricate with regard to the costs of both materials and labor, and which securely holds the retained roll. The invention contemplates the use of a skid or pallet combined with a pair of corrugated paperboard end sections, one for each end of the roll, a pair of anti-roll retainers, and a pair of top braces, the entire structure being secured together by banding straps.

The corrugated paperboard end sections and the antiroll retainers secure the retained roll from endwise shifting and sidewise rolling motion, and are so constructed that a standard sized end section is utilizable with rolls of widely varying diameters. The resultant structure is standardized in external dimensions and may be handled by fork lift trucks without damage to the retained roll. The dimensional standardization provides for ease of stacking, and the structural arrangement is such that when the retained roll is removed for use the structure is flat stackable in a high density configuration for return shipping and re-use if such is desired.

Accordingly, it is a primary object of the invention to provide a novel roll retainer structure which is economical to fabricate with regard to both material and labor.

Another object of the invention is to provide a novel roll retainer as aforesaid which utilizes standardized components including a pallet type structure, a pair of identical opposite roll end retainer structures and standard banding materials.

A further object of the invention is to provide a novel roll retainer structure as aforesaid in which the opposite end structures for retaining the roll in position are fabricated of corrugated paperboard.

Still a further object of the invention is to provide a novel roll retainer as aforesaid in which the roll retainer end structures are adaptable for use with cylindrical rolls of varying diameter.

The foregoing and other objects of the invention will become clear from a reading of the following specification in conjunction with an examination of the appended drawings, wherein:

FIG. 1 is an isometric view from above of a roll retainer structure embodying the principles of the invention showing an assembly of such structure with a retained roll;

FIG. 2 is a front elevation of a roll retainer end pad when viewed from the side which faces the end of the retained roll;

FIG. 3 is a fragmentary enlarged view of the top edge of the roll retainer end pad shown in FIG. 2, as would be seen when viewed along the line 3—3 of FIG. 2;

FIG. 4 is an unfolded flat plan view of a triangular retainer tube made of corrugated paperboard which is used in conjunction with the roll retainer end pad shown in FIG. 2;

In the several figures, like elements are denoted by like reference characters.

Figure 5:
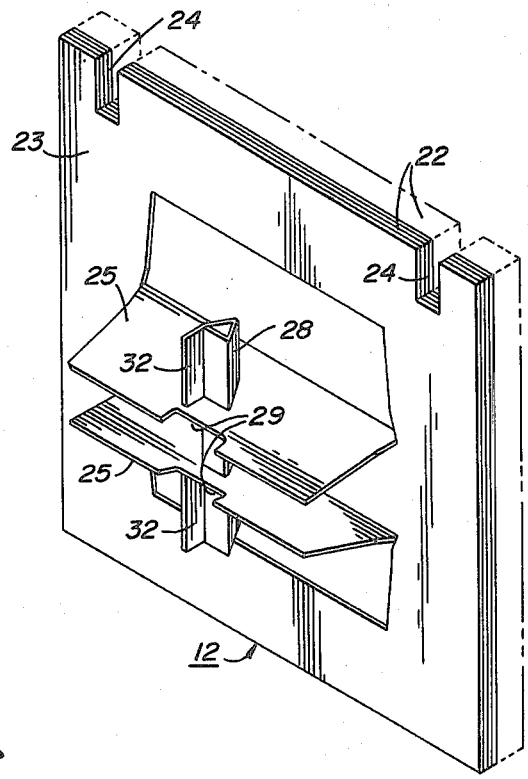
FIG. 5 is an isometric view of the roll retainer end pad shown in flat form in FIG. 2, the pad being shown in assembled ready for use form.

Considering now the figures, there is seen a roll retainer structure designated generally as 10, including a pallet or skid 11, a pair of roll retaining end pads 12, a pair of width-wide spaced apart top braces 13, a pair of transversely extending straps 14 which secure the retained roll 15 to the pallet 11, and a pair of longitudinally extending straps 16 which encircle and secure fixedly together the pallet 11 and roll retaining end pads 12 with the top braces 13.

The pallet or skid is illustrated as being made of wood and as shown includes a pair of longitudinally extending side timbers 17 to the top of which are transversely fixedly secured a number of widthwise extending interior timbers 18, and width-wise extending opposite end timbers 19. Extending longitudinally centrally between the side timbers 17 and beneath and secured to all of the widthwise timbers is a central timber 20, and extending longitudinally of the pallet and spaced apart and extending parallel to the side and central timbers of the pallet are a pair of anti-roll timbers 21 seated downward upon and fixedly secured to the widthwise extending interior timbers 18, the anti-roll timbers being shown as stopping short of the opposite ends of the pallet.

Figure 6:
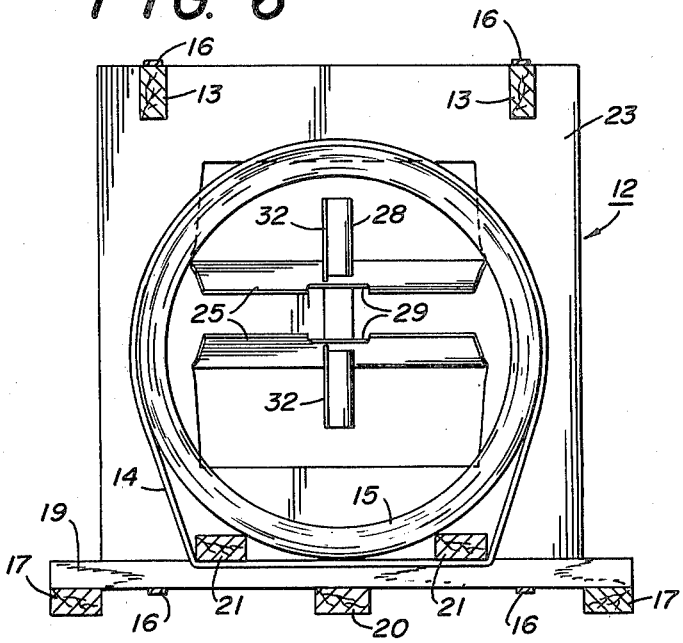
FIG. 6 is a vertical cross-sectional view through the assembled structure of FIG. 1 as would be seen when viewed along the line 6—6 of FIG. 1.

As best seen in the showings of FIGS. 1 and 6, the hollow roll 15 is seated upon the widthwise extending interior timbers 18 of the pallet and between the anti-roll timbers 21 with the opposite open ends of the cylindrical roll 15 abutting the inside faces of the roll retaining end pads 12. The banding straps 14 are trained around the roll 15 and anti-roll timbers 21, passing beneath those timbers and above the central timber 20 between adjacent pairs of the interior widthwise extending timbers 18. With the banding straps 14 pulled tight and secured, and with the end pads 12 in place, the roll 15 is restrained from both lateral and endwise movement within the retainer structure 10.

The roll retaining end pads are each fabricated of a number of cemented together double wall corrugated paperboard panels 22 and one paperboard end panel 23. All of the panels are of approximately equal width and height, and are all provided with a pair of spaced apart top notches 24 within which are seatable the ends of the top braces 13. The panel 23 has die cut therethrough a pair of generally trapezoidal flaps 25, both of which fold about parallel scored hinging lines 26 so that the flaps are foldable away from the plane of the panel toward the center of the panel and toward one another.

Each of the flaps are provided with a triangular punchout 27 through which are conjointly disposable a triangular cylindrical brace tube 28, and with a pair of upper and lower knockouts 29 which permit grasping of the flaps 25 so that they may be pulled away from the immediately adjacent panels 22 against which the remainder of the panel 23 is secured. As best seen in FIGS. 4, 5 and 6, the triangular brace tube 28 is formed from three fully extending panels 30 separated by a pair of score lines 31, and a longitudinally extending end panel divided into top and bottom sections 32 and a mid section 33, the end sections 32 being separated from the mid section 33 by a pair of cut lines 34.

The ends pads 12 are set up for use by first pulling the flaps 25 away from the body of the pad and folding them outward toward one another, then inserting the triangular brace tube 28 through the triangular punch-outs 27 and adjusting the tube so that the brace tube end sections 32 can be pulled away from the tube 28 to prevent flaps 25 from moving away from one another beyond the inner ends of the end sections 32. The mid section 33 of the brace tube 28 may also be pulled away from the tube if desired to wedgelock the flaps 25. When thus assembled with the brace tube 28, the flaps 25 form a wedge shaped structure best seen in FIGS. 5 and 6.

Typically, a package is assembled by first placing a roll 15 on the pallet 11 between the anti-roll timbers 21. Next, a pair of erected end pads are moved against opposite ends of the roll 15 with the wedge shaped structure formed by the flaps 25 inserted within each end of the roll 15 with the side edges of the flaps engaging the inside edge of the roll, the pads 12 being seated upon the pallet end timbers 19. Then, the top braces 13 are seated downward into the top notches 24 of the end pads 12, and the banding straps 16 are trained about the pallet, end pads and top braces and pulled up tight and secured. Finally, the banding straps 14 are run transversely around the roll 15 and the underlying anti-roll timbers 21 and fixedly secured. The package is now complete and ready for storage or shipment. At the destination, it is only necessary to cut the straps 14 and 16 to disassemble the package and remove the roll 15 for use. The end pads 12 and top braces 13 may then be layed flatwise downward upon the pallet 11 to form a volumetrically compact assembly for local storage or return to the shipping point if desired.

It will be observed from FIG. 6 that the wedge shaped structure formed by the flaps 25 is not exactly centered vertically within the roll 15, this being because of the particular diameter of the roll. A roll of sufficient size to have its outer diameter approach the top of the pad 12 will automatically cause the flaps 25 to be substantially centered within the roll. The centering is not particularly relevant since the upper flap is sufficient by itself to provide the desired function. However, from this it is understood that a relatively wide range of roll diameters is accommodatable by the standardized end pad 12.

Having now described the invention in connection with a particularly illustrated embodiment thereof, it will be appreciated that variations and modifications of the invention may now occur from time to time to those persons normally skilled in the art without departing from the essential scope or spirit of the invention, and accordingly it is intended to claim the same broadly as well as specifically as indicated by the appended claims.

What is claimed to be new and useful is:

1. A retaining package for open ended hollow cylindrical rolls of material made of erectable and collapsible components which when not in erected use condition are flat stackable for high density return shipment of the package for subsequent re-use, comprising in combination, (a) a bottom support structure upon which the cylindrical roll is seatable, said support structure comprising an essentially planar rigid frame rectangular pallet having a pair of parallel widthwise extending opposite end members intersecured by lengthwise extending side members, (b) a pair of opposite end pads supported respectively on said pair of opposite end members, each said end pad being constructed of multiple layers of corrugated paperboard fixedly secured together, one end layer of each pad having a pair of apertured trapezoidal flaps turned out of the plane thereof about parallel hinging lines which form the longer trapezoidal base of each flap so that the flaps are foldable away from the plane of the end pad toward the center of the pad and toward one another with the edges of said flaps formed by the shorter trapezoidal base being positioned in spaced apart relation to one another with the flaps inclined toward one another, and a rigid brace tube removably intersecurable with said pair of flaps of each pad effective to hold said flaps fixed in their inclined position, said brace tube extending between said flaps and through said flaps apertures and having end retainer sections positionally adjustable to interlock said tube with said flaps and hold the latter in fixed position, said opposite end pads being oriented so that the said flaps of each pad face toward the flaps of the other pad and are insertable axially within the opposite open end of the hollow cylindrical roll of material to be packaged with the trapezoidal sides of at least one flap of each pad being engaged with the inside of each end of the hollow roll, and (c) securing means for fixedly securing together said end pads and bottom support pallet.

* * * * *